United States Patent [19]

Lane

[11] Patent Number: 4,473,973

[45] Date of Patent: Oct. 2, 1984

[54] GUTTER SYSTEM

[75] Inventor: Tim A. Lane, Windsor, Ohio

[73] Assignee: The Commercial Siding & Maintenance Company, Painesville, Ohio

[21] Appl. No.: 444,353

[22] Filed: Nov. 24, 1982

[51] Int. Cl.[3] ..... E04D 13/00

[52] U.S. Cl. ..... 52/13; 52/15; 52/60

[58] Field of Search ..... 52/11, 13, 94, 12, 95, 52/14, 15, 60, 58, 588; 248/48.1, 48.2

[56] References Cited

U.S. PATENT DOCUMENTS

| | | | |
|---|---|---|---|
| 1,419,126 | 6/1922 | Besnard | 52/13 |
| 3,057,117 | 10/1962 | Singer | 52/11 |
| 3,334,454 | 8/1967 | Abrams | 52/11 |
| 3,426,488 | 2/1969 | Stanford | 52/15 |
| 3,436,878 | 4/1969 | Singer | 52/95 |
| 3,474,589 | 10/1969 | Cheatwood | 52/58 |
| 3,501,873 | 3/1970 | Berg | 52/11 |
| 3,821,512 | 6/1974 | Stanford | 52/11 |
| 3,911,632 | 10/1975 | Bryfogle et al. | 52/13 |
| 3,911,633 | 10/1975 | Bamberger | 52/58 |
| 4,195,452 | 4/1980 | Smith et al. | 52/94 |
| 4,196,554 | 4/1980 | Anderson et al. | 52/588 |

FOREIGN PATENT DOCUMENTS

| | | | |
|---|---|---|---|
| 860565 | 1/1971 | Canada | 52/588 |
| 1468595 | 12/1966 | France | 52/11 |

*Primary Examiner*—John E. Murtagh
*Assistant Examiner*—Andrew Joseph Rudy
*Attorney, Agent, or Firm*—Maky, Renner, Otto & Boisselle

[57] ABSTRACT

A gutter system characterized by a continuous snap lock hinge connection between a gutter and hanger therefor which allows the gutter and hanger to be relatively angularly adjusted in the field for use with different roof configurations, and which then is secured against hinged movement by bonding to provide a continuous rigid support for the gutter as well as a continuous water seal between the gutter and hanger. The hanger includes an anchoring flange having a reversely under-turned edge portion forming a hook; whereas each of the gutter side walls has an inwardly-turned top edge terminating at an enlarged bead adapted to be transversely snapped into the bight of the hook for hinged movement therein. The interengaged hook and bead allow the gutter and hanger to be relatively angularly adjusted as desired until an adhesive interposed between mating surfaces thereof sets or cures to form a rigid bond that holds the gutter and hanger in the desired adjusted angular relation.

13 Claims, 5 Drawing Figures

GUTTER SYSTEM

DISCLOSURE

This invention relates generally as indicated to a gutter system and more particularly to a gutter and hanger arrangement.

BACKGROUND

It is well known to employ hangers to attach eaves, troughs or gutters to a building at the lower edge or edges of the building roof. Many known gutter and hanger arrangements, however, have a common drawback in that they often are restricted in their manner of erection and application. In some arrangements, for example, the hanger requires attachment to a vertical facia board or plate on the edge of the roof. As a result, such arrangements cannot be employed with buildings that do not have such facia boards or plates or when such manner of attachment is undesirable or unacceptable. It also is noted that often there is inadequate protection against water overflowing into the adjacent building structure when the capacity of the gutter is exceeded. Such overflow and passage of water into the building, needless to say, is undesirable and may result in structural damage to the building.

In U.S. Pat. No. 3,436,878, for instance, there is disclosed a combined leaf guard and hanger which is designed to be mounted on a facia board suspended from the roof eave or, under certain limited circumstances, to the side wall of the building. The hanger is secured to the facia board and has a hook on the lower edge thereof for mating supporting engagement by a bead at the top edge of the inner wall of the gutter. The gutter also is supported at its outer wall by another turned bead thereon which snaps over a bead on the end of a foraminous sheet extending outwardly from the upright flange.

Other gutter and hanger arrangements are also known to employ hangers having a gutter clip or attachment portion and a flange or flashing portion that may be anchored to the roof. In U.S. Pat. No. 4,195,452, the illustrated hanger has a lower clip portion and an integral flashing portion which when connected to a building, extends upwardly at an angle matching the angle or pitch of the roof. An obvious drawback of this arrangement is that different hangers are required for roofs of different pitches.

One attempt to provide a gutter and hanger arrangement which is adjustable to the slope or pitch of the roof is disclosed in U.S. Pat. No. 3,057,117. The gutter thereof is U-shape and has an inwardly and upwardly inclined neck portion that terminates at a bead of generally circular cross-section. The bead is sized to fit in an elongated circular socket on the lower end of one leg of an L-shape hanger. Both legs of the hanger are provided with fastener holes so that the hanger can be secured to the overhang of a roof or to a vertical surface of the building. With hangers thus installed, the bead of the gutter is slid endwise into the sockets of the hangers and then pivoted at such sockets to transversely level the gutter. To hold the gutter in the desired angular relation to the hanger, pins are passed through diametrically opposed holes in the hanger socket and holes in the bead of the gutter.

SUMMARY

The present invention provides an improved gutter system particularly characterized by a continuous hinge connection between a gutter and hanger therefor which allows the gutter and hanger to be relatively angularly adjusted in the field for use with different roof configurations, and which then is secured against hinged movement by bonding to provide a continuous rigid support for the gutter that is capable of withstanding severe environmental conditions. Moreover, the bonded hinge connection provides a continuous water seal which prevents water overflow into the adjacent building structure.

Briefly, a gutter system according to the invention comprises a gutter and hanger having respective hinge members interengaged to secure the gutter to the hanger while providing for relative angular adjustment thereof, and an adhesive bond for holding the hinge members together against relative movement after adjustment thereby to fix the gutter in the desired adjusted angular relation. Accordingly, the hanger and gutter can be angularly adjusted to match, for example, the angle of a supporting building structure while transversely leveling the gutter, and then fixed by the adhesive bond which rigidly and firmly holds the gutter and hanger in their desired adjusted angular relation.

More particularly, the hanger includes an elongate flange or flashing adapted to be anchored flush with a roof at the lower edge thereof. The flange terminates along a longitudinal edge thereof at a reversely underturned hook that overhangs the roof edge. On the other hand, the gutter, which also is elongate, includes a bottom wall and side walls, at least one side wall of which has an inwardly turned top edge terminating at an enlarged bead which is confined for hinged movement in the bight of the hanger hook. The bead and hook desirably are angularly adjustable through a range of approximately 90° for accommodating any roof slope or pitch. Moreover, the bead and hook are desirably coextensive throughout the length of the gutter and hanger whereby a continuous snap-lock hinge may be provided. Also, the inwardly projecting top edge of the side wall and continuously adhered hanger form an effective, continuous water stop which prevents overflow of water into the building.

Further in accordance with the invention, the hanger and gutter preferably are formed by extrusion in equal lengths and also are made of fiberglass reinforced plastic which offers resistance to corrosive environments while providing desired gutter strength capable of withstanding severe environmental conditions. Also, the material forming the hanger at the hook thereof has sufficient resiliency so that the bead can be transversely snapped into the socket or bight of the hook. As a result, a bead of adhesive may be run along the hook socket and then the bead transversely snapped into place. The gutter may then be transversely leveled and held, such as by pins extending through the hook and bead, until the adhesive forms a rigid bond between the bead and hook.

Still further in accordance with the invention, each side wall of the gutter may be provided with the aforesaid bead to permit selective securement of either side of the gutter to the hanger. Moreover, both sides of the gutter may be secured to respective hangers for installation of the gutter in a valley formed between two roofs.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIGS. 4 and 5 are fragmentary vertical sections showing exemplary applications of the gutter system to different types of roof configurations.

DETAILED DESCRIPTION

Figures 1, 2, 3:
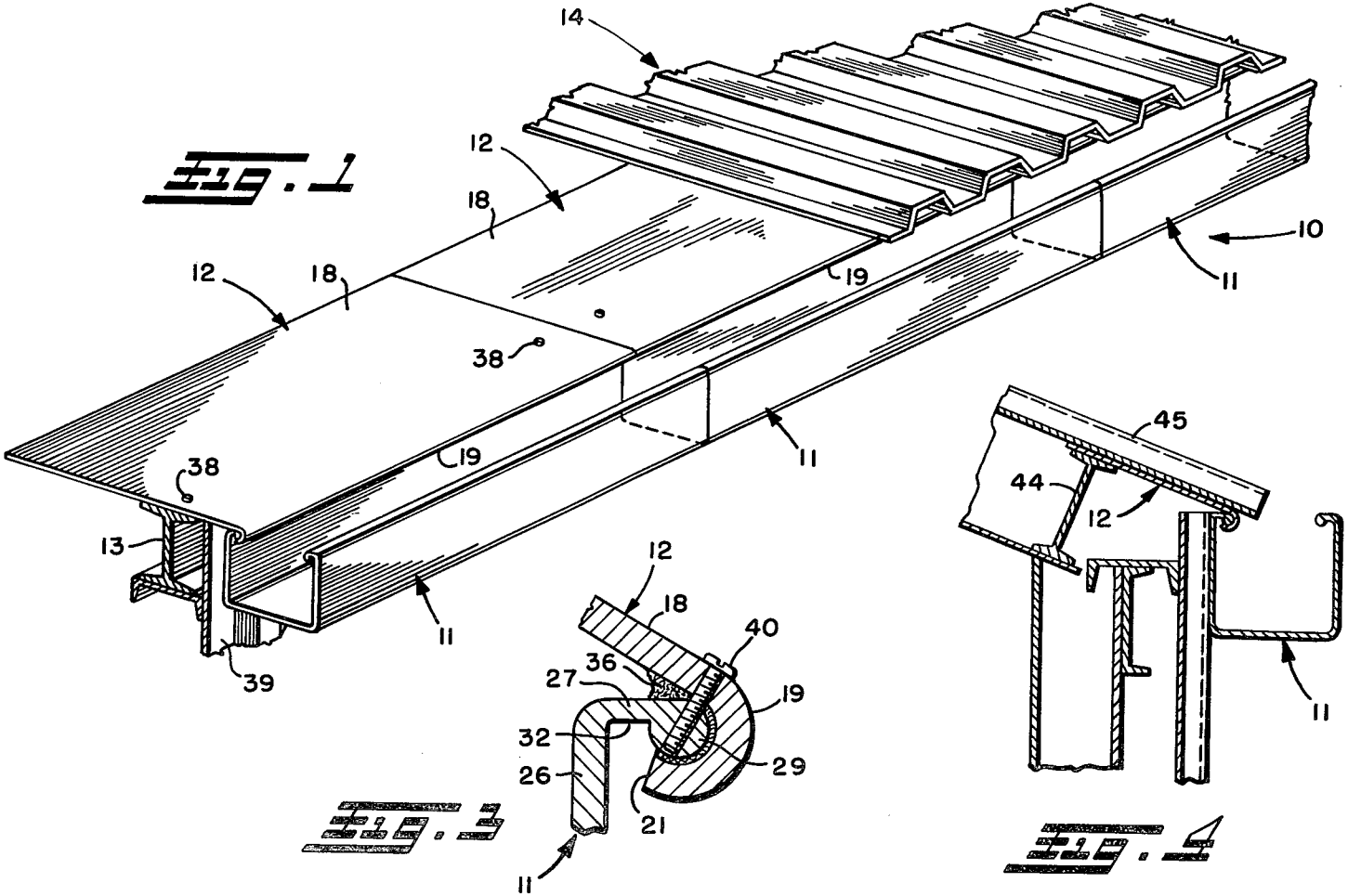
FIG. 1 is a perspective view of an installed preferred form of gutter system according to the present invention.
FIG. 2 is an end view of a gutter and hanger arrangement according to the invention showing in particular the continuous snap lock hinge connection thereof.
FIG. 3 is an enlarged fragmentary end view of the snap lock hinge connection of FIG. 2 after bonding and sealing thereof in accordance with the invention.
Figure 2:
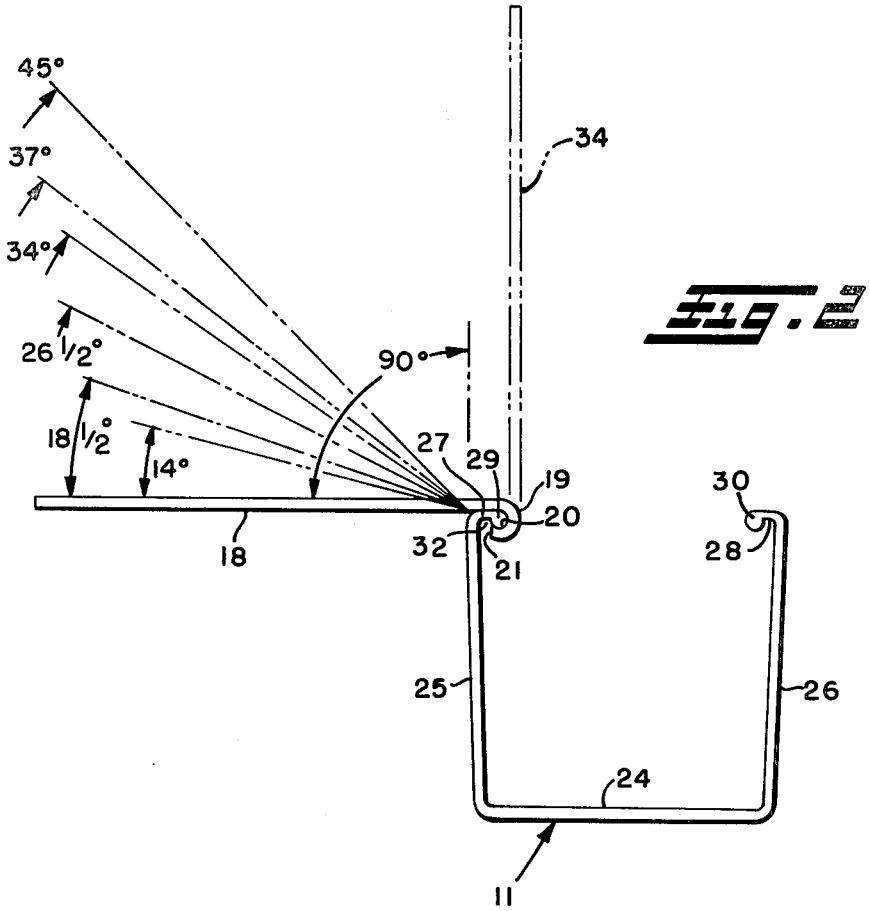

Referring now in detail to the drawings and initially to FIG. 1, a gutter system according to the invention is designated generally by reference numeral 10. The gutter system 10 includes one or more lengths of gutters 11 and hangers 12 which are anchored to a roof truss beam 13 at the edge of the roof 14. As shown, each length of gutter and hanger therefor are desirably of equal length and butted end-to-end to adjacent gutters and hangers, respectively, to form a continuous gutter work along the edge of the roof. The butted gutters and hangers may be joined by suitable adhesives and/or sealing compounds or by accessories, and end caps may also be provided at the ends of the gutter. Likewise corner pieces and the like may be provided as needed to match the gutter to the edge contour of the roof. Also the lengths of the gutters and hangers may be varied such as by cutting standard lengths to desired size.

In FIG. 2, the illustrated hanger 12 can be seen to have an anchoring flange or flashing 18 which is essentially planar and desirably extends substantially the full length of the hanger. The flange terminates along a longitudinal edge thereof at a reversely under-turned hook 19 that also desirably extends the length of the hanger. The hook 19 is generally semi-circular in transverse cross-section whereby it defines in the bight thereof a socket 20 which is generally semi-circular in transverse cross-section. It further is noted that the terminating end 21 of the hook is preferably turned slightly back towards the flange as the hook preferably has an arcuate length slightly greater than 180°.

As also seen in FIG. 2, the illustrated gutter 11 is desirably generally U-shape in transverse section, including a bottom wall 24 and side walls 25 and 26. Each side wall 25, 26 preferably has an inwardly turned top edge 27, 28 terminating at an enlarged bead 29, 30 which is generally semi-circular in transverse cross-section. More particularly, the beads 29, 30 are transversely dimensioned so that either one will closely fit lengthwise in the socket 20 formed by the hanger hook 19 and provide a hinged connection between the gutter and hanger 12. As shown, the bead 29 (or 30) preferably is received in the socket 20 and retained therein by reason of the hook 19 extending more than 180° around the bead. That is, the terminating end 21 of the hook defines with a coextending portion of the flange 18 a socket opening which has a transverse width slightly less than the diameter of the bead. Accordingly, the bead and hook define hinge members which may be interengaged or, more particularly, interlocked to secure the gutter to the hanger while providing for relative angular adjustment thereof.

As will be appreciated, the hanger flange 18 may be pivoted relative to the gutter to extend at a variety of angles so as to match, for instance, the pitch or slope of a roof, while the gutter 11 may be angularly adjusted relative to the hanger 12 so as to transversely level the same. Preferably, such adjustment is permitted through an angular range of approximately 90° so as to accommodate a like range of roof pitches or slopes. The hanger flange, for example, may extend horizontally as seen in solid lines in FIG. 2 or vertically as seen in phantom lines at 34, or at any other angular inclination therebetween as schematically indicated. When horizontal, the flange 18 of the hanger can be seen to butt against the top surface of the inwardly turned top edge 27 of the side wall 25 or 26 which tangentially joins the curved outer surface of the bead 29 or 30 at a point vertically above the center of such bead. On the other hand, the terminating end 21 of the hook is accommodated in a slightly upwardly recessed underside 32 of such top edge when the flange thereof extends vertically as seen at 34 in FIG. 2.

The gutter 11 is preferably made of fiberglass reinforced plastic but may be made of other materials suitable for gutter applications such as galvanized steel, aluminum, copper, stainless steel, transite or other plastic materials. Likewise, the hanger is desirably made of the same material as the gutter, and both the gutter and hanger preferably are fabricated by extrusion, it being noted that the gutter and hanger are respectively of constant transverse cross-section along their lengths. Of course, the gutter and hanger may be made of different materials if desired.

Also, the hanger 12 at the hook 19 thereof preferably is sufficiently resilient to permit insertion or snapping of the bead 29 or 30 into the socket 20 through the socket opening. That is, the terminating end 21 of the hook is resiliently movable away from the hanger flange 18 to allow transverse passage of the bead therethrough and trapping of the bead in the socket.

Although the bead 29 and hook 19 preferably are interlocked as aforedescribed, advantageous results may still be obtained by simple interengagement between the bead and hook. In either case, it is desirable to provide for transverse insertion of the bead into the hook for a reason that will become more apparent hereinafter.

Referring now to FIG. 3, it will be seen that the bead 29 and hook 19 are shown locked or fixed together against the aforementioned hinged movement by a bonding agent such as an adhesive 36. Preferably there is a small clearance between the mating surfaces of the bead and hook to accommodate the adhesive. Accordingly, the adhesive which extends substantially around the bead will form a strong bond between such mating surfaces. Also, the adhesive may extend beyond such mating surfaces as shown to further adhesively lock and fix the hanger and gutter at a desired adjusted angular relation. Although any suitable adhesive may be employed, an epoxy is particularly suited for use with fiber reinforced plastic hangers and gutters.

The adhesive 36 preferably extends the full length of the coextending hanger 12 and gutter 11 to assure a rigid and strong joint. Also, the adhesive additionally serves as a continuous seal between the hanger and gutter so that any water that overflows the gutter cannot leak into the adjacent building structure. It also is noted that the thus bonded bead and hook project inwardly from the side wall 25 of the gutter and thus additionally serve as a water dam. It has been found that such a joint provides an effective water stop which prevents overflow into buildings and forms a strong and rigid structure capable of withstanding severe environmental conditions.

To install the gutter 11 and hanger 12 on a building at the edge of a roof, the hanger may first be secured to a support therefor. As seen in FIG. 1, the hanger flange 18 may be secured by fasteners 38 to the roof truss beam 13 adjacent the edge of the roof with the hook 19 thereof extending beyond the vertical side wall 39 of the building. Once anchored in place, a bead of adhesive may be run in the hook socket along the length of the hanger and an appropriate one of the gutter beads then inserted or snapped transversely into the socket.

At this point, before the adhesive sets up or cures, the gutter 11 may be transversely leveled by angular adjustment relative to the hanger 12. When properly adjusted, the gutter may be temporarily held in place by a few fasteners 40 (as illustrated in FIG. 3) to allow for drying or curing of the adhesive and to facilitate speedy erection. As seen in FIG. 3, the pin fasteners 40 may be in the form of screws which pass through both the hook 19 and bead 29. Only a few such fasteners are needed to hold the gutter in place until the adhesive dries or cures. Once the adhesive has set up, the fasteners may be left in place or removed for better appearance as desired.

As will become apparent to those skilled in the art, the gutter 11 and hanger 12 may be installed in a variety of ways other than that just described For example, the gutter and hanger may be assembled together before anchoring of the hanger to the roof. In any event, it will be appreciated that the gutter and hanger may be angularly adjusted to match a wide range of roof pitches or slopes, or for that matter, other gutter supports.

As seen in FIG. 4, such a hanger 12 may, for example, be secured to an angularly disposed roof truss beam 44 extending along the edge of the roof while the gutter 11 is held transversely level. Once thus installed, roof material such as corrugated roofing 45 may be assembled over the flange of the hanger as indicated.

Figure 5:
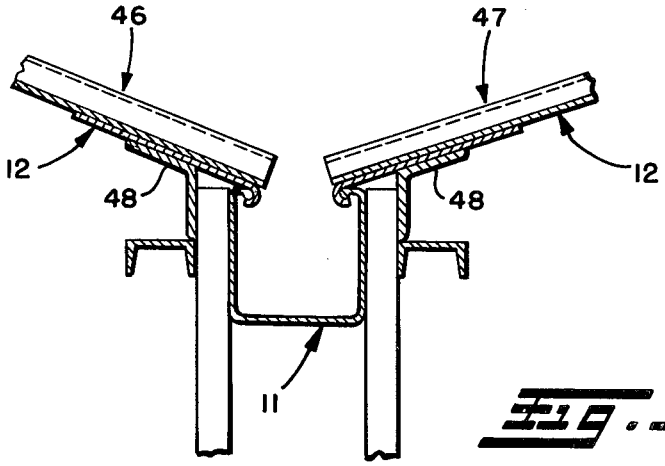

In FIG. 5, it can be seen that the gutter 11 and hanger 12 may be installed in the valley extending between two sloping roofs 46 and 47. In this case, the gutter is secured at both beads by respective hangers which in turn are anchored to angle irons 48 adjacent the longitudinal edges of the roofs.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claims.

The embodiments of the invention in which an exclusive property or privilege is claimed are defined as follows:

1. A gutter system comprising a gutter and a hanger therefor, said gutter including a bottom wall and side walls, one side wall of which has an inwardly turned top edge extending substantially perpendicular toward the other side wall and terminating at an enlarged bead, and said hanger including a flange portion terminating at a reversely under-turned edge forming a hook adapted to receive said enlarged bead for hinged movement therein, said bead being generally semi-circular in cross-section, said hook defining a generally semi-circular, transversely open socket for said bead, said hook and bead provide for angular adjustment of said hanger approximately 90° relative to said gutter and said flange portion at one extreme end position of said hanger being substantially horizontal and at the other extreme end position being substantially vertical.

2. A system as set forth in claim 1 wherein said top edge has a top surface tangentially joining the curved outer surface of said bead.

3. A system as set forth in claim 1 wherein said bead has a diameter greater than the transverse width of the socket opening, and said hook is sufficiently resilient to permit insertion of said bead into said socket through said socket opening whereby said bead can be transversely snapped into said socket.

4. A system as set forth in claim 3 wherein said gutter and hanger are extruded from fiber reinforced plastic material.

5. A system as set forth in claim 1 wherein the other side wall of said gutter is similarly provided with an inwardly turned top edge extending toward said one side wall and terminating at an enlarged bead whereby either side wall of said gutter can be selectively secured to a hanger or secured to respective hangers.

6. A system as set forth in claim 1 wherein the underside of said top edge is upwardly recessed to accommodate the terminating end of said hook when said flange portion is substantially vertical.

7. A system as set forth in claim 1 wherein said top edge extends substantially perpendicular to said one side wall, and said flange portion butts against said top edge when said flange portion is substantially horizontal.

8. A system as set forth in claim 1 further comprising bonding means for securing said bead within said hook against hinged movement following adjustment thereof thereby rigidly to hold said gutter and hanger in an adjusted angular relation.

9. A system as set forth in claim 8 wherein said bead and hook extend substantially continuously along the lengths of said gutter and hanger.

10. A system as set forth in claim 9 wherein said bonding means extends substantially continuously along the lengths of said bead and hook to provide a continuous water seal along the length of said gutter and hanger.

11. A system as set forth in claim 8 wherein said bonding means includes a curable or settable adhesive.

12. A system as set forth in claim 11 further comprising pin means passing through said bead and hook for holding said bead and hook against relative movement while said adhesive cures or sets.

13. A gutter system comprising a gutter and a hanger therefor, said gutter including a bottom wall and side walls, one side wall of which has an inwardly turned top edge extending toward the other side wall and terminating at an enlarged bead, and said hanger including a flange portion terminating at a reversely under-turned edge forming a hook adapted to receive said enlarged bead for hinged movement therein, said bead being generally semi-circular in cross-section, and said hook defining a generally semi-circular transversely open socket for said bead, said bead having a diameter greater than the transverse width of the socket opening, and said hook being sufficiently resilient to permit insertion of said bead into said socket through said socket opening whereby said bead can be transversely snapped into said socket, said hook and bead providing for angular adjustment of said hanger of approximately 90° relative to said gutter, said flange portion at one extreme end position of said hanger being substantially horizontal and at the other extreme end position being substantially vertical, the underside of said top edge being upwardly recessed to accommodate the terminating end of said hook when said flange portion is substantially vertical, said top edge extending substantially perpendicular to said one side wall, and said flange portion butting against said top edge when said flange portion is substantially horizontal, and bonding means for securing said bead within said hook against hinged movement following adjustment thereof thereby rigidly to hold said gutter and hanger in an adjusted angular relation, said bead and hook extending substantially continuously along the lengths of said gutter and hanger, and said bonding means extending substantial continuously along the lengths of said bead and hook to provide a continuous water seal therebetween.

* * * * *